US008816273B2

(12) United States Patent
Suarez et al.

(10) Patent No.: US 8,816,273 B2
(45) Date of Patent: Aug. 26, 2014

(54) ZERO DEAD TIME, HIGH EVENT RATE, MULTI-STOP TIME-TO-DIGITAL CONVERTER

(75) Inventors: George Suarez, Burtonsville, MD (US); Jeffrey J. Dumonthier, Ashburn, VA (US)

(73) Assignee: The United States of America as represented by the Administrator of the National Aeronautics Space Administration, Washington, DC (US)

( * ) Notice: Subject to any disclaimer, the term of this patent is extended or adjusted under 35 U.S.C. 154(b) by 186 days.

(21) Appl. No.: 13/595,604

(22) Filed: Aug. 27, 2012

(65) Prior Publication Data

US 2014/0054455 A1 Feb. 27, 2014

(51) Int. Cl.

| | |
|---|---|
| ***H01J 49/00*** | (2006.01) |
| ***G04F 10/00*** | (2006.01) |
| ***H01J 49/40*** | (2006.01) |

(52) U.S. Cl.

CPC ..... *G04F 10/005* (2013.01); *H01J 49/40* (2013.01)

USPC ..... 250/287; 250/281; 250/282

(58) Field of Classification Search

CPC ..... G04F 10/005

USPC ..... 250/281, 282, 287; 702/27, 28, 189

See application file for complete search history.

(56) References Cited

U.S. PATENT DOCUMENTS

| | | | | |
|---|---|---|---|---|
| 5,777,326 | A * | 7/1998 | Rockwood et al. | 250/287 |
| 7,804,290 | B2 * | 9/2010 | Henzler et al. | 324/76.82 |

* cited by examiner

*Primary Examiner* — Michael Maskell

(57) ABSTRACT

Time-to-digital converters adapted to analog and digital inputs and methods of use are described. A time-to-digital converter has an event frame latches and logic module with memory cells, an analog front-end module connected to the memory cells, and a bin increment generator module connected to the memory cells. The bin increment generator is configured to issue bin increments separated by a time increment, and the analog front end is configured to issue a start event followed by a plurality of stop events. Upon receipt of a first time increment following a start event, the event frame latches and logic module updates a first memory cell with a first bit-type; upon receipt of a second time increment following an intervening stop event, the event frame latches and logic module updates a second memory cell with a second bit-type different from the first bit-type.

13 Claims, 9 Drawing Sheets

ZERO DEAD TIME, HIGH EVENT RATE, MULTI-STOP TIME-TO-DIGITAL CONVERTER

INVENTION BY GOVERNMENT EMPLOYEE(S) ONLY

The invention described herein was made by an employee of the United States Government, and may be manufactured and used by or for the Government for governmental purposes without the payment of any royalties thereon or therefor.

ORIGIN OF INVENTION

1. Field

The aspects of the present disclosure relate generally to time-to-digital converters. More specifically, the aspects of the present disclosure relate to a zero dead time, high event rate, multi-stop time-to-digital converter.

2. Background

Mass spectrometry is a tool for identifying the composition of unknown substances. One type of mass spectrometer is a time-of-flight mass spectrometer (TOF-MS). A TOF-MS operates by receiving an unknown sample substance, breaking the sample into constituent particles, charging the constituent particles, and driving the charged constituent particles along a path of known length. Ideally, timing electronics associated with the TOF-MS measure a discrete time interval required by each charged particle to transit the path of known length. These discrete time intervals can then be aggregated and analyzed, such as by constructing an unknown substance histogram or mass spectrum constructed of the discrete particle flight times. The unknown substance histogram can then be compared to a library of characteristic histograms of known substances. Matches or similarities between the unknown substance histogram and the characteristic histograms can then be used to identify the unknown substance.

One challenge in constructing a TOF-MS is a need to precisely measure a time interval taken by any given charged particle to transit a flight path of a known length path in the TOF-MS. Typically, TOF-MS's employ timing electronics that recognize a given particle's start time down the known-length path. These timing electronics also recognize the given particle's arrival at the end of the path, and thereby associate a time interval to the particle's transit of the path which can then be processed by associated data processing electronics and software. These time intervals (particle flight times) are a function of the path length of the TOF-MS, a TOF-MS having a smaller flight path reporting a shorter flight time interval for a given particle than a TOF-MS having a longer flight path. Consequently, the more precisely at TOF-MS's timing electronics can measure a given fight time interval, the shorter the required flight path length. The shorter the flight path, the smaller the TOF-MS incorporating the flight path need be. Where size is important, such as in space exploration where it is desirable to include a miniaturized TOF-MS in an instrument package provided for in-situ planetary science, small instrument size is desirable.

Another challenge in constructing a TOF-MS is a need to distinguish individual particle arrivals when large numbers of particles arrive at the end of the flight path in a relatively short period of time. A TOF-MS operates by imparting a common amount of kinetic energy to the constituent ions of the sample, thereby accelerating the particles to different particle velocities that are a function of the mass of any given particle. These different particle velocities cause the particles to disperse along the flight path during their respective transits of the path, less massive particles traveling quickly and having shorter transit intervals, and more massive particles traveling more slowly and having longer transit intervals. Consequently, the more particles arrivals the timing electronics can recognize in a given period of time (event rate), the shorter the flight path need be. Where size is important, such as in space exploration where it is desirable to include a miniaturized TOF-MS in an instrument package provided for in-situ planetary science, small instrument size is desirable.

Consequently, there exists a need for a high event rate, multi-stop time-to-digital timing electronics. The timing electronics should allow for precise relative time measurements between a start pulse indicating a start event followed by a stop pulse indicating a stop event with a resolution of less than 500 picoseconds. There is a further need that the timing electronics be capable of handling a continuous series of stop events associated with a single start event, and be able to recognize a subsequent start event. The timing electronics should have high resolution and high linearity, and be able to process low level analog signals coming such as would be provided from a micro-channel plate (MCP) detector of a TOF-MS as well as be able to process digital signals associated with other types of instruments.

Accordingly, it would be desirable to provide a laser heterodyne radiometer system that addresses at least some of the problems identified above.

BRIEF DESCRIPTION OF THE INVENTION

As described herein, the exemplary embodiments overcome one or more of the above or other disadvantages known in the art.

One aspect of the exemplary embodiments related to a time-to-digital converter. In one embodiment, the time-to-digital converter comprises an event frame latches and logic module, an analog front-end module connected to the event frame latches and logic module having a plurality of memory cells, and a bin increment generator module connected to the event frame latches and logic module. The bin increment generator is configured to continuously issue a sequence of bin increments to the event frame latches and logic module separated by a time increment. The analog front-end module is configured to issue an event start indication to the event frame latches and logic module followed by at least one event stop pulse to the event frame latches and logic module. The event frame latches and logic module is configured to sequentially update a memory cell of the plurality of memory cells upon receipt of each bin increment. The memory cell update comprises a first bit-type where the update occurs after the receipt of a start event by the event frame latches and logic module, and comprises a second bit-type where the update occurs after the receipt of a stop event by the event frame latches and logic module.

Another aspect of the exemplary embodiments relates to a method of time-to-digital conversion. In one embodiment, the method comprises, at a time-to-digital converter comprising an event, frame latches and logic module with a plurality of memory cells, the event frame latches and logic module being connected to a bin increment generator module and an analog front end module; issuing an event start indication to the event frame latches and logic module using the analog front end module; issuing a first bin increment to the event frame latches and logic module using the bin increment generator module; and storing, upon the issue of the first bin increment, a first bit in a first memory cell of the event frame latches and logic module; issuing an event stop indication to the event frame latches and logic module using the analog front end module; issuing a second bin increment to the event frame latches and logic module using the bin increment generator module; and storing, upon the issuing of the second bin increment, a second bit in a second memory cell of the event frame latches and logic module. The first bit is of a first hit-type and the second bit is of a second bit-type, the first bit-type being different than the second bit-type in recognition of the issue of the event stop indication by the analog front-end module.

A further aspect of the disclosed embodiment relates to a time-of-flight mass spectrometer system. In one embodiment, the spectrometer comprises a particle flight path of known length beginning at an accelerometer of the spectrometer and ending at a detector of the spectrometer. A time-to-digital converter is connected to the accelerator, the detector, a processor, and a memory. The memory further comprises a non-transitory media with instructions recorded thereon that, when read by the processor, cause the converter to issue an event start indication to the event frame latches and logic module using the analog front end module; issue a first bin increment to the event frame latches and logic module using the bin increment generator module; store, upon the issue of the first bin increment, a first bit in a first memory cell of the event frame latches and logic module, the first bit-type memorializing the issue of the start event issue by storing the first bit as a first bit-type; issue a second bin increment to the event frame latches and logic module using the bin increment generator module; and store, upon the issuing of the second bin increment, a second bit in a second memory cell of the event frame latches and logic module, the second bit memorializing the issue of the stop event issue as a second bit-type, the second bit-type being different than the first bit-type.

These and other aspects and advantages of the exemplary embodiments will become apparent from the following detailed description considered in conjunction with the accompanying drawings. It is to be understood, however, that the drawings are designed solely for purposes of illustration and not as a definition of the limits of the invention, for which reference should be made to the appended claims. Additional aspects and advantages of the invention will be set forth in the description that follows, and in part will be obvious from the description, or may be learned by practice of the invention. Moreover, the aspects and advantages of the invention may be realized and obtained by means of the instrumentalities and combinations particularly pointed out in the appended claims.

BRIEF DESCRIPTION OF THE DRAWINGS

The accompanying drawings illustrate presently preferred embodiments of the present disclosure, and together with the general description given above and the detailed description given below, serve to explain the principles of the present disclosure. As shown throughout the drawings, like reference numerals designate like or corresponding parts.

DETAILED DESCRIPTION OF SPECIFIC EMBODIMENTS

Detailed illustrative embodiments of example embodiments are disclosed herein. However, specific structural and functional details disclosed herein are merely representative for purposes of describing example embodiments. The example embodiments may, however, be embodied in many alternate forms and should not be construed as limited to only example embodiments set forth herein.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of example embodiments.

Figure 1:
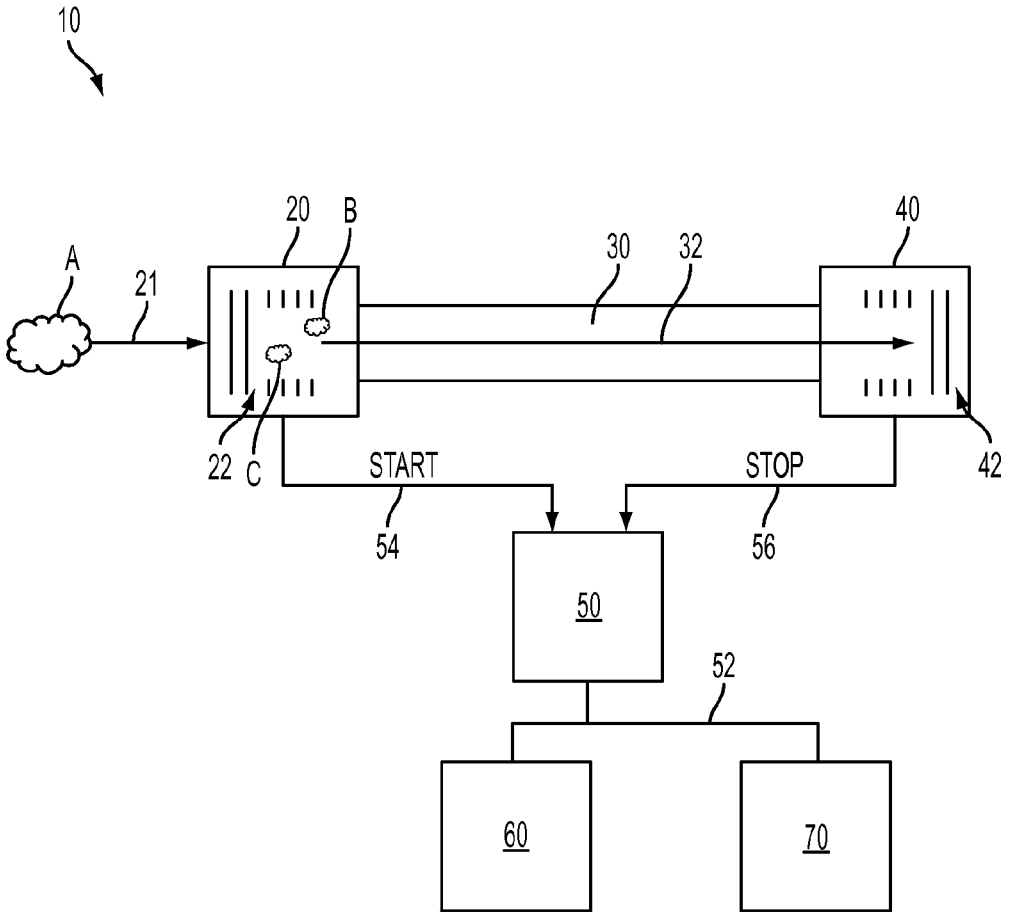
FIG. 1 is block diagram of a time-of-flight mass spectrometer.

FIG. 1 shows a schematic diagram of a time-of-flight mass spectrometer 10. The time-of-flight mass spectrometer (TOF-MS) 10 comprises an accelerator 20 having a plurality of charge plates 22, a flight region 30, a detector 43 having a plurality of charge plates 42, and a flight path 32 extending from the accelerator charge plates 22 to the detector charge plates 42. The TOF-MS 10 further comprises a time-to-digital converter 50, a processor 60, and a memory 70. The time-to-digital converter (TDC) 50 connects to the accelerator 20 over a link 54, and to the detector 42 over a link 56. The TDC 50 also communicates with the processor 60 and the memory 70 over a link 52. As illustrated in the FIG. 1, the link 52 is a communications bus adapted for data communication between the TDC 50, the processor 60, and the memory 70. In an embodiment, the detector 40 further comprises a micro-channel plate detector adapted the register charged particle arrivals in the detector with an analog output.

Operatively, a sample of an unknown substance A is introduced into the accelerator 20. During sample introduction, the sample A is ionized, such as with an electron beam (not shown), thereby breaking the sample A into a first charge particle B and a second charged particle C. As illustrated in FIG. 1, charged particle C is larger than charged particle B, charged particle C having a greater mass than that of charged particle B.

Once ionized, charged particles B, C are introduced into the accelerator 20. Controls associated with the TOF-MS (not shown) then charge the accelerator charge plates 22, thereby imparting a common kinetic energy to the particles B, C, and accelerating the particles B, C into the flight region 30 and along the flight path 32. Upon accelerating at least one charged particle down the flight path 32, the accelerator 20 memorializes the start by issuing a start indication to the TDC 50 using the link 54. As used herein, the phrase 'start event' means recognizing a departure of at least one charged particle from the accelerator 20.

Since the particles B, C have different masses and are accelerated to a common kinetic energy level, the particles accelerate to different velocities. Because the particles B, C travel at different velocities, the particles B, C traverse the flight path at different speeds, and reach the detector 40 at different times. Upon arrival of an individual particle at the detector 40, the detector memorializes the moment of arrival in the plurality of detector charge plates 22 by issuing an indication to the TDC 50 using the link 56. As used herein, the phrase 'stop event' means recognizing an arrival of a charged particle in the detector 40. As would be recognized by one of skill in the art, multiple stop events may be associated with a single start event due to differently sized particles traversing the flight path 32 at different rates, the velocity of a given particle being a function of its mass to charge ratio.

As described below, the TDC 50 is configured to memorialize in time a start event, memorialize in time at least one stop event associated with the start event, and memorialize a time interval between a given stop event and its associated start event. As used herein, a 'time interval' is an intervening period of time between a start event and a stop event.

Figure 2:
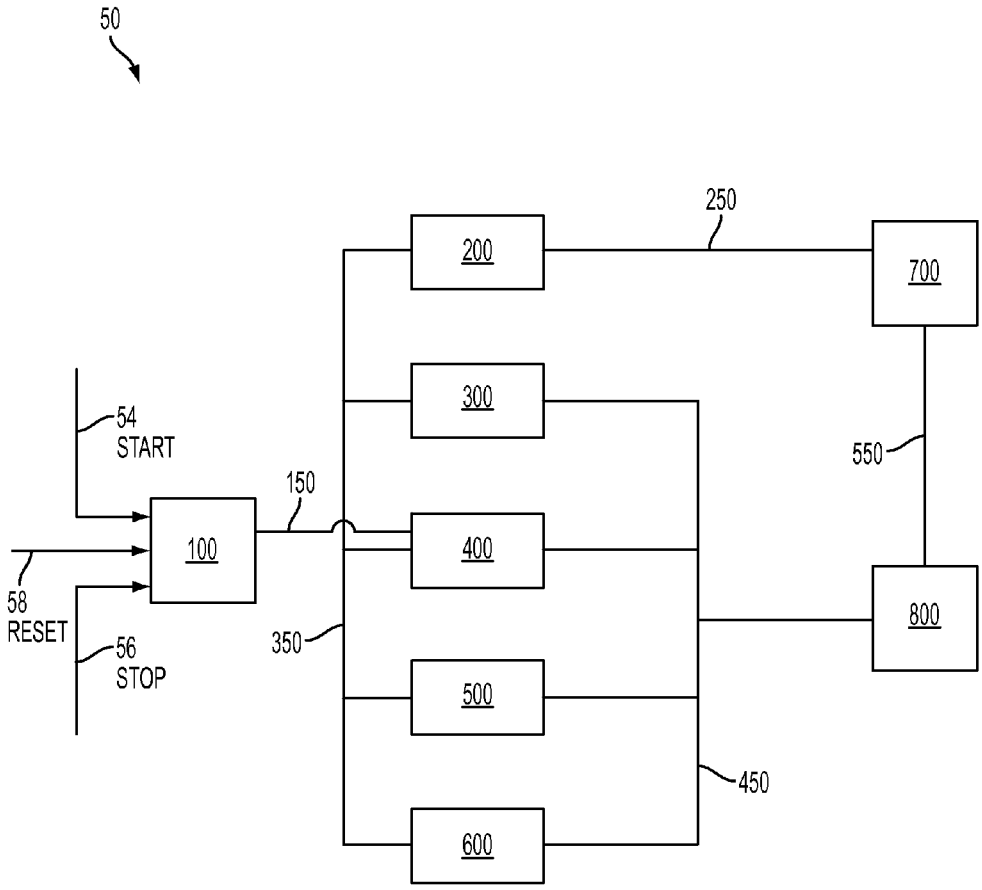
FIG. 2 is a block diagram of timing electronics for a time-of-flight mass spectrometer.

FIG. 2 shows a functional block diagram of an exemplary TDC 50. The TDC 50 comprises an analog front-end module (AFE) 100, a bin increment generator module (BIG) 200, a readout clock module 300, an event frame latches and logic module (EFLL) 400, a synchronization counter module 500, a calibration frame latches and logic module (CFLL) 600, a data processing module (DPM) 700, and a bin size setting module (BSS) 800. As used herein, the term 'module' means (i) one or more physical structures constructed within an integrated circuit microelectronics implemented in silicon, (ii) one or more machine readable algorithms recorded on a non-transitory machine-readable media that, when read by a processor, cause the processor to execute certain actions, or (iii) a combination of (i) and (ii).

The TDC 50 further comprises a link 150, a link 250, a link 350, a link 450, and a link 550. The link 150 connects the AFE 100 with the EFLL 400. The link 250 connects the BSS 700 with the BIG 200. The link 350 connects the BIG 200 with the EFLL 400. The link 450 connects the EFLL with the DPM 800. The link 550 connects the DPM 800 with the GSS 700. The link 350 connects together the BIG 200, the readout clock module 300, the EFLL 400, the synchronization module 500, and CFLL 600. The link 450 connects together the readout clock module 300, the EFLL 400, the synchronization module 500, and CFLL 600. In embodiments the connections may be arranged using at least one shared bus and/or at least one dedicated conductor (not shown) between elements in view of the communications and data exchanges between modules as discussed herein. In an exemplary embodiment the AFE module 100, the bin increment generator module 200, the readout clock module 300, the EFLL 400, the synchronization clock module 500, and the CFLL are implemented as single application specific integrated circuit (ASIC), and the DPM 700 and BSS 800 are implemented as an off-chip processing unit or device, the ASIC and the off-chip processing unit or device (FGPA) being connected by at least one link 250, 340 connecting the devices. In an embodiment, the off-chip processing unit or device comprises a second ASIC.

The bin increment generator takes data comprising bits (1's and 0's) produced by the time-to-digital converter corresponding to events in a particular frame, and converts it into data suitable for processing into event information. In an embodiment, the bin increment generator comprises a second chip connected to the time-to-digital converter with a communications link such as a data bus. In another embodiment, the bin increment generator is fabricated on the same chip as the bin increment generator and connected through microstructure comprising a communication link. Advantageously, embodiments comprising a bin increment generator and time-to-digital converter provide an integrated package having (i) fewer connections, in (ii) a smaller package, thereby providing more functionality in a single package comprising less weight, having a smaller foot print, and requiring less power.

The AFE 100 is configured to receive start events, stop events, and reset events. Upon receipt of a start event, the AFE 100 memorializes time between the start event a plurality of subsequently occurring stop events. Upon receipt of a reset event, the AFE 100 is prepared to receive a subsequent start event to the previously received at least one stop event passed from the accelerator 20 to the AFE 100 over link 54. The AFE is also configured to receive at least one stop event passed from the detector 40 to the AFE 100 over the link 56. In an embodiment subsequently occurring stop events follow by an associated start event separated by short time intervals. For example, in an embodiment a time interval between a start event and subsequent occurring stop event is approximately 400 picoseconds. In an embodiment stop events arrive in rapid succession. For example, in an embodiment the AFE 100 receives approximately $2\times10^9$ stop events per second maximum burst rate.

Figure 3:
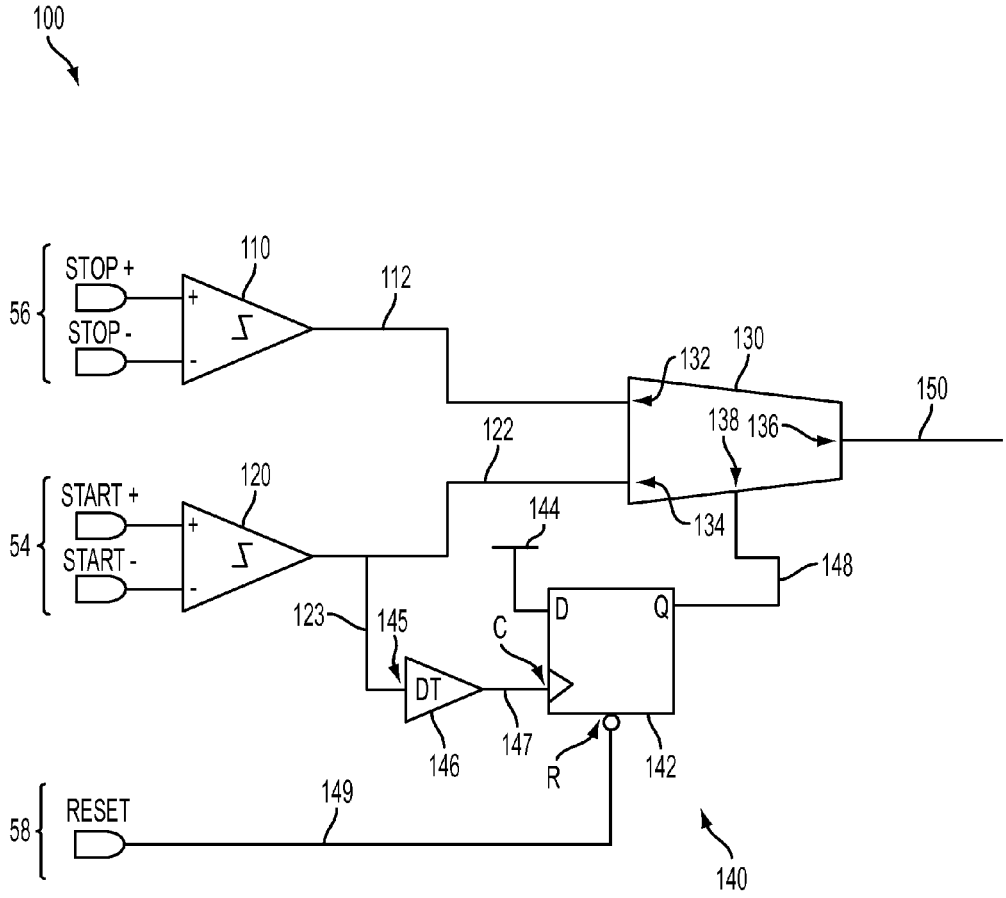
FIG. 3 is a block diagram of an analog front-end module of timing electronics of FIG. 2.

FIG. 3 shows an exemplary embodiment of an AFE 100. The AFE 100 comprises a first comparator 110, a second comparator 120, a multiplexor 130, and a channel select circuit 140. The multiplexer 130 further has a first input channel 132, a second input channel 134, a channel-select input 138, and a mux output 136. The mux output 136 interfaces the AFE 100 to the EFLL 400 over the link 150. A link 112 connects the output of the first comparator 110 to the first input channel 132 of the mux 130. A link 122 connects the output of the second comparator 120 to the second input channel 134 of the mux 130. A channel select input link 148 connects the channel select circuit 140 with the select input 138 of the mux 130. The first comparator 110 further comprises a high and a low stop event input 56. The second comparator 120 further comprises a high and a low start event input 54.

The channel select circuit 140 comprises a state storage cell 142 having three inputs and an output, and an inverter 146. A link 123 connects the inverter 146 to the output of the second comparator 120. A link 147 connects the output of inverter 147 to a first input of the state storage cell 142. A link 144 connects a reference voltage to a second input of the state storage cell 142. A link 149 connects a reset input 158 to the third input of the state storage cell 142. A link 148 connects an output of the state storage cell 142 to the channel select input 138 of the mux 130. In the illustrated embodiment, the state storage cell 142 is a flip-flop, and the inverter 146 applies a clock pulse to the flip-flop first input. In other embodiments, the state storage cell 142 is a memory structure implemented in silicon such as an SRAM, DRAM, or flash memory cell configured to hold and iteratively re-write the cell contents.

Operatively, the mux 130 provides at the mux output 136 one of an output of the first comparator 100 and the an output of the second comparator 120 based on start event, stop event, and reset input using the channel select input received at the channel select input 138 of the mux 130. Upon initialization, the mux 130 selects the output of the comparator 120 provided over the link 122 to the second input channel of the mux 130. It relays this to the mux output 136, to the link 150, which passes the output to the EFLL 400. The second comparator 120 outputs a low voltage when no start event has registered, which is passed to both the mux 130 over the link 122, and to the inverter 146 of the channel select circuit 140 over the link 123.

The inverter periodically charges and discharges on an interval dependent upon its characteristic capacitance, thereby showing the state-storage cell 142 the low voltage output by the second comparator on a time interval delta-t. Each low pulse of the inverter 146 cause the cell 142 to store a 0-bit, which the cell 142 outputs to its output Q. The 0-bit output Q is applied the mux channel select input 138, which causes the mux 130 to remain connected to output of the second comparator 120. This arrangement places the AFE 100 in a start event wait mode, where the output of the detector is not relayed through the mux to the EFLL 400.

The second comparator 120 recognizes a start event by a selecting an applied positive voltage. This positive start indication reaches the inverter 146 over the link 123, and is applied to the state storage cell at the second input. This causes the storage cell state value to change from a 0-bit to a 1-bit. The 1-bit is relayed across the output Q of the cell 142, arriving at the channel select input 138 of the mux 130, and causing the mux 130 select the first channel input 132. The mux 130 thereafter monitors the stop event output of the first comparator 110, which is passed to the mux output 136, to the link 150 and thereafter to the EFLL 400. This arrangement places the mux 130 in a stop event wait mode, where the output of the detector is relayed through the mux to the EFLL 400 until such time as the content of the cell 142 changes from a 1-bit to a 0-bit.

The reset input 58 is operative to change the cell 142 content from a 0-bit to a 1-bit. Thus, when a reset input 58 arrives at the R input of the cell 142, cell content changes to a 0-bit upon the next pulse of the inverter 146. The 0-bit is relayed to the mux 130 over the link 148 to the mux channel select input 138, and the mux 130 switches from the input applied at the first input channel 132 from the first comparator to the input applied at the second channel input 134 from the second comparator.

Figure 4:
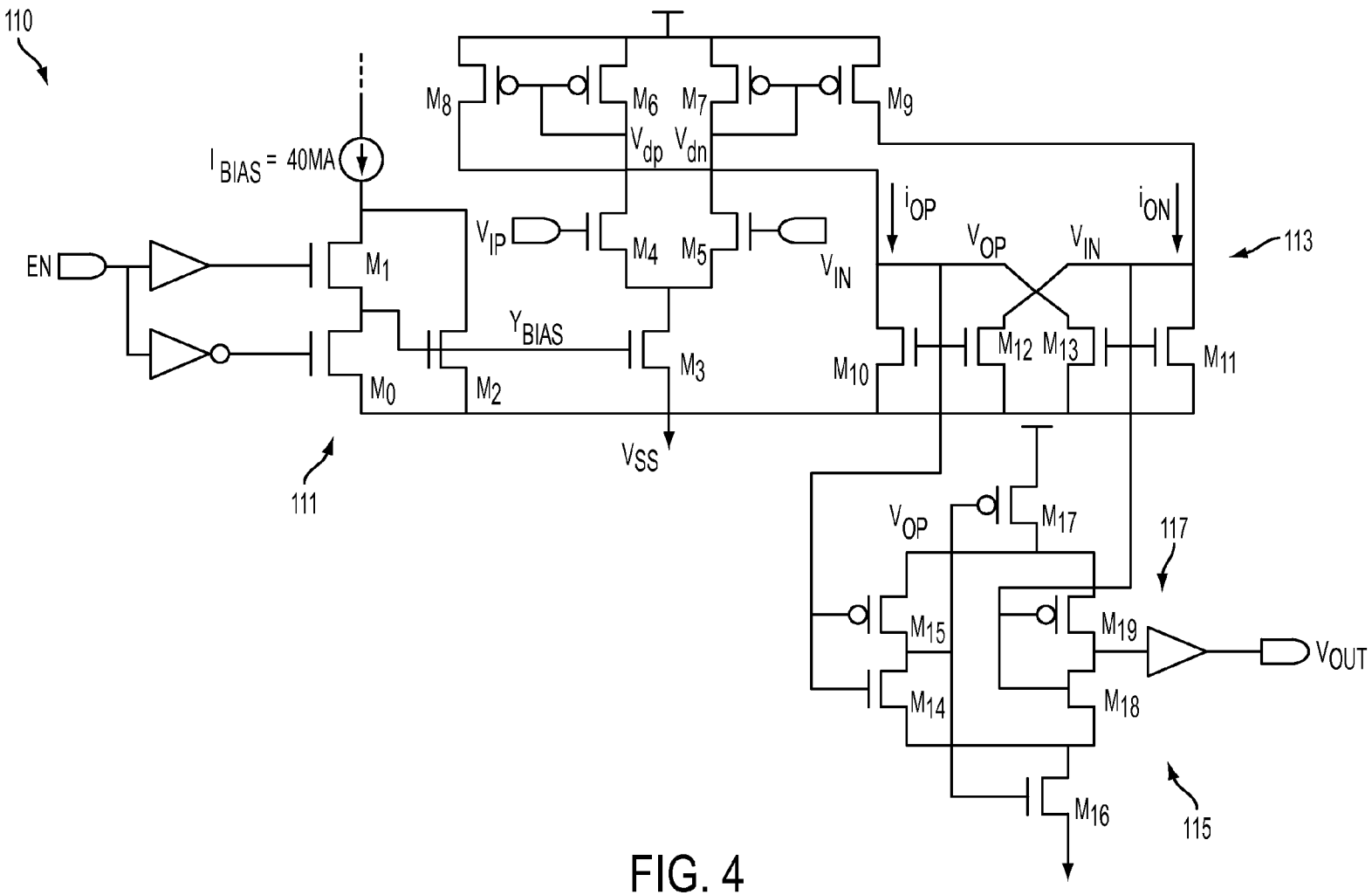
FIG. 4 is the schematic for a high-speed comparator for the analog front-end module of FIG. 3.

FIG. 4 shows a schematic view an embodiment of the first comparator 110. The comparator 110 uses a single pre-amplification stage having a non-latched topology. The comparator 110 comprises an input preamplifier (111 having transistors $M_0$-$M_9$ as arranged in the figure), a positive feedback decision stage (113 having transistors $M_{10}$-$M_{13}$ as arranged in FIG. 4), and self-biased buffer output stage (115 having transistors $M_{14}$-$M_{19}$ as arranged in FIG. 4) having a driving output logic buffer. When enabled (en=logical 1), the comparator 110 operates such that $V_{out}$=logical 1 where $V_{ip}>V_{in}$ and $V_{out}$=logical 0 where $V_{ip}<=V_{in}$. In an embodiment, the comparator 110 is a high-speed, continuous (non-latched) comparator designed and optimized in the jazz CA18HD 180 nm CMOS process.

The input pre-amplifier stage 111 comprises an NMOS differential pair with active PMOS loads. Advantageously, the stage accepts wider voltage swings by employing thick oxide 3.3V transistors. The input preamplifier stage 111 converts the voltage difference between input voltages $V_{ip}$ and $V_{in}$ into output currents $i_{op}$ and $i_{on}$ such that, when voltage $V_{ip}$ is greater than $V_{in}$, the current $i_{op}$ is positive, the current $i_{on}$ is negative, and the current $i_{op}$ equals the opposite value of the current $i_{on}$. Oppositely, when voltage $V_{ip}$ is less than or equal to $V_{in}$, the current $i_{op}$ is negative, the current $i_{on}$ is positive, and the current $i_{op}$ equals the value of the current $i_{on}$. Advantageously, the input pre-amplifier stage achieves high speed by avoiding high-impedance nodes.

The decision stage 113 discriminates the voltages $v_{op}$ and $v_{on}$. The stage 113 uses positive feedback implemented by cross coupled NMOS devices to detect changes in the voltage $v_{op}$ and the voltage $v_{on}$. For example, assuming that the voltage $V_{ip}$ is much larger than the voltage $V_{in}$, $M_{10}$ is saturated and $M_{11}$ is in cutoff ($v_{on}$=0). If the current $i_{on}$ increases, then the voltage $v_{on}$ correspondingly increases while the current $i_{op}$ and the voltage $v_{on}$ correspondingly decrease. Switching starts when the voltage $v_{gs8}$ equals the voltage $v_{in}$. As the voltage $V_{gs8}$ increases beyond $v_{in}$, $M_{13}$ takes the current away from $M_{10}$, thereby decreasing the voltage $v_{op}$ until it turns off $M_{12}$. Since $M_{10}$ through $M_{13}$ are sized substantially equally, switching (discrimination) therefore occurs when the current $i_{op}$ substantially equals the current $i_{on}$.

The output stage 115 receives the output from the decision stage 113 in an output buffer 117. The output buffer 117 receives the differential (and varying) voltages $v_{op}$ and $v_{on}$, and converts the voltages into a logical using a complementary self-biased differential buffer. Advantageously, the circuit achieves a very high quiescent current by connecting the gates of $M_{16}$ and $M_{17}$ to internal node (average $v_{op}$) and operating $M_{16}$ and $M_{17}$ in their linear region. Since $v_{op}$ and $v_{on}$ are complementary, the average of $v_{op}$ equals $v_{on}$. When $v_{op}$ is greater than $v_{on}$, $M_{15}$ is on, thereby biasing $M_{17}$ to source a current through $M_{19}$. Similarly, when $v_{op}$ is less than $v_{on}$, $M_{14}$ turns on and biases $M_{16}$ to sink a high current through $M_{16}$.

In an embodiment, the pre-amplifier stage 111 has a nominal gain of approximately 11.5 dB (3.75) and a −3 dB bandwidth of approximately 2 Ghz. In an embodiment, the decision stage 113 has a gain of approximately 17.8 dB (7.8), cumulative gain including the pre-amplifier stage 111 gain of 29.3 dB (29.2) and a −3 dB bandwidth of 482 MHz. In an embodiment, the output of the self-biased buffer 117 is 32.7 dB (43.1) and the cumulative gain and −3 dB are 62 dB (1258.9) and 200 MHz.

Advantageously, the above-described APE 100 can be employed in a TDC receiving analog or digital input. This allows the TDC 50 to be used in applications beyond a TDC-MS, for example but not limited to laser ranging, nuclear and high-energy physics experiments, ultrasonic-based flow and density measurements, quantum cryptology, laser-induced spectroscopy, photon counting, and measurement of propagation delays in integrated circuits.

Figure 5A:
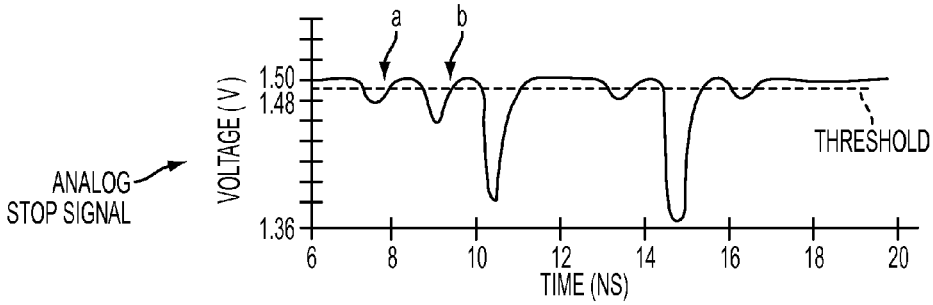
FIG. 5A and FIG. 5B illustrate graphically an exemplary analog input and response to the analog input from the analog front-end module of FIG. 3.
Figure 5B:
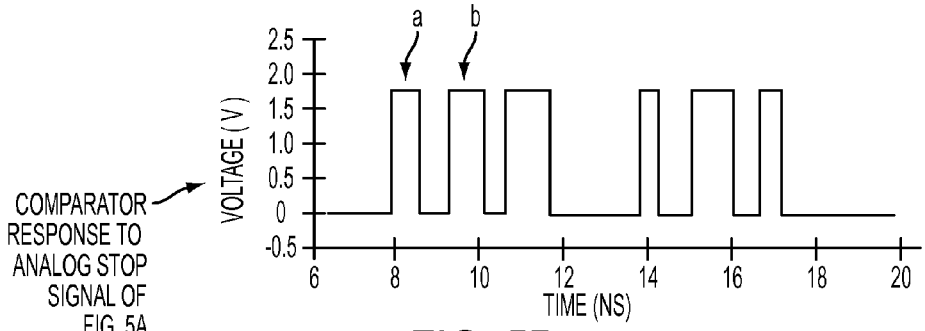

FIGS. 5A and 5B illustrate an exemplary response of the comparator 110 to an exemplary analog stop event input signal. FIG. 5A shows the exemplary analog stop event signal trace, e.g. that of an MCP detector signal employed by a TOF-MS. FIG. 58 shows the corresponding exemplary comparator response to the input signal trace of FIG. 5A. The analog signal trace illustrated the in FIG. 5A runs at around 1.5 volts when the detector is not receiving charged particles, and drops below a threshold of 1.49 volts to as low as 1.36 volts are charged particles impact the detector. FIG. 5B shows an exemplary comparator response starting substantially about the time the stop event tail crosses above the threshold, and continuing for around the same length of time. In a case of the first stop event a, the comparator response time is about 1 nanosecond. In the case of a second stop event b, the comparator response time is around 1.5 nanoseconds. Advantageously, the signal amplitude has no impact on the comparator output, and extremely short-lived events appear in comparator response with a duration correlating well with the duration of the stop input trace modulations.

A high event rate TDC increases the sensitivity and resolution of the TOF-MS by maximizing efficiency of signal collection from each sample collected by the TOF-MS. This is critical in applications such as in-situ planetary science, where analysis samples may be difficult to obtain. In an embodiment, stop events from the TOF-MS detector are approximately 400 picoseconds wide, have amplitudes between approximately 10 to 100 millivolts, and occur with a frequency of approximately $2\times10^9$ events per second. Advantageously, a high event TDC can also provide reduced flicker noise due to avoidance of multiple integration cycles to build up the mass spectrum that exhibit the varying ionization efficiencies, source extraction volatility, varying space charge, and basic ion statistics. Moreover, a TDC having a high event rate allows for a smaller TOF-MS because the TDC can distinguish between detector stop events separated by smaller time intervals, requiring less flight time and smaller flight paths for different ions between the TOE-MS accelerator and detector. In an embodiment, the TDC has an event rate of approximately 700 MHz.

Figure 5C:
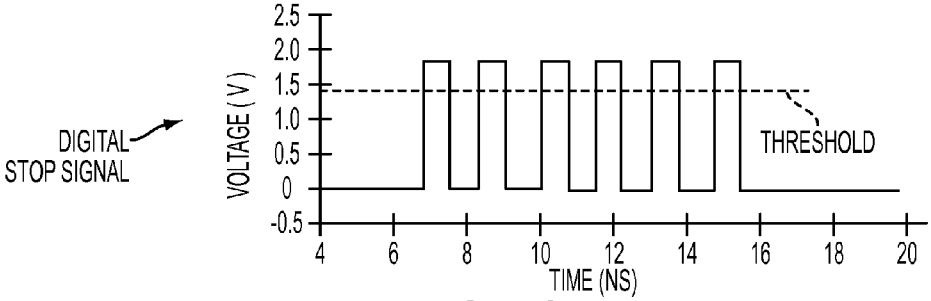
FIG. 5C and FIG. 5D illustrate graphically an exemplary digital input and response to the digital input from the analog front-end module of FIG. 3.
Figure 5D:
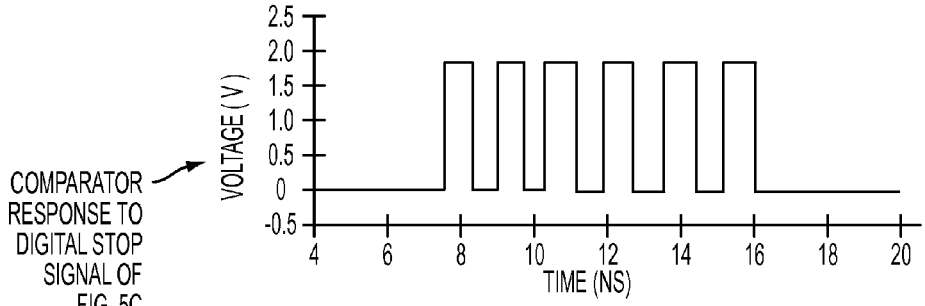

FIGS. 5C and 5D illustrate an exemplary response of the comparator 110 to an exemplary digital stop event input signal. FIG. 5C shows the exemplary digital stop event signal trace. FIG. 5D shows the corresponding exemplary comparator response to the digital input trace of FIG. 5C. The exemplary digital stop signal trace illustrated the in FIG. 5C runs at approximately 0 volts when the detector is not registering an event, and rises above a 1.4 volt threshold to around 1.75 volts for the duration of the event. The exemplary comparator output shown in FIG. 5D starts after a fixed interval, and continues for the duration of time period the digital stop event signal in FIG. 5C is above the threshold value of 1.49 volts. Because the stop signal is digital, amplitude is of no concern, and as with the analog exemplary response the digital response signal trace of FIG. 5D correlates well with the stop event digital trace of FIG. 5C.

Figure 6:
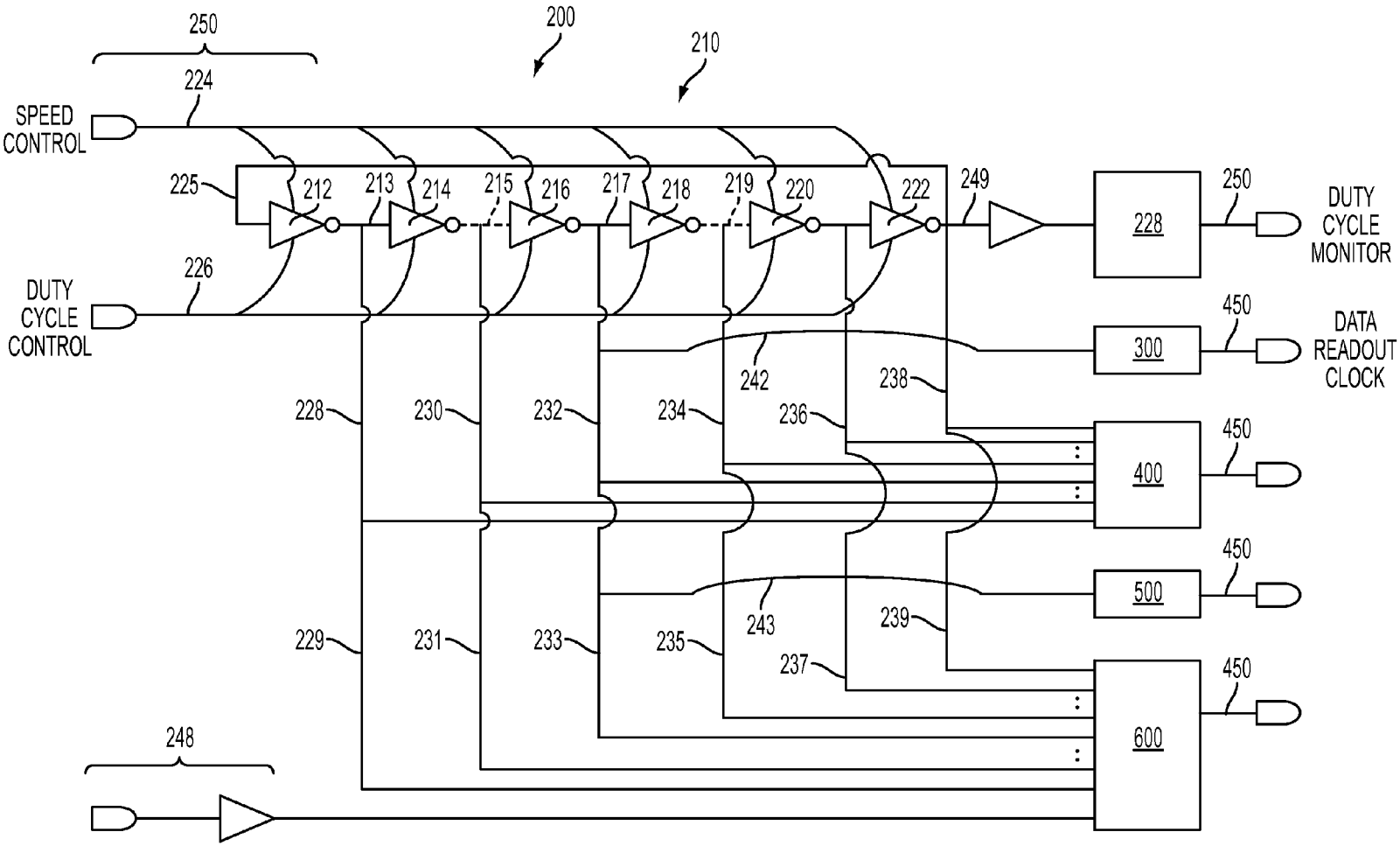
FIG. 6 is a block diagram of a bin increment generator of the timing electronics of FIG. 2.

FIG. 6 shows a schematic view of an embodiment of the BIG 200.

The BIG 200 comprises a voltage controlled oscillator 210, a speed control input link 224, a duty control input link 226, a data readout output link 242, and a duty cycle monitor output link 249. The voltage controlled oscillator (VCO) 210 further comprises a plurality of stages. In the illustrated embodiment, each stage comprises an inverter, the first stage comprising an inverter 212, the second stage comprising a second inverter 214, the third stage comprising a third inverter 216, the fourth stage comprising a fourth inverter 218, the fifth stage comprising a fifth inverter 220, and the sixth stage comprising a sixth inverter 222.

The inverters 212, 214, 216, 218, 220, and 222 are arranged serially from left to right, each inverter comprising a comprising a stage of the VCO 210. Each inverter 212, 214, 216, 218, 220, 222 of the VCO 210 receives a first output comprising the speed control input voltage 224. Each inverter 212, 214, 216, 218, 220, 222 of the VCO 210 also receives a second input comprising the duty cycle control input voltage 226. Each inverter 214, 216, 218, 220, 212 further receive a third input comprising an output of the inverter of inverter preceding it (e.g. to the left of each inverter as shown in FIG. 4) with the exception of the left-most first inverter 212. Inverter 212 receives as its third input the output of the last inverter as illustrated with a link 225 connecting the output of the sixth inverter 222 to the input of the first inverter 212. As shown in FIG. 2, the speed control input 224 and the duty cycle control input 226 are passed to the BIG 50 over the link 250. As also shown in FIG. 2, the clock input 240 is passed to the BIG 50 over the link 450, through the DPM 800, over the link 550, through the BSS 700, and over the link 250. The exemplary six stage inverter arrangement shown in FIG. 6 is for illustration purposes only and non-limiting. Embodiments of the VCO 210 have differing numbers of inverters as appropriate given the invented application of the TDC 50. This is illustrated by a dotted link 215 connecting an output of the second inverter 214 to an input of the third inverter 216, and by a dotted link 219 connecting an output of the fourth inverter 218 to an input of the fifth inverter 220. In one embodiment, the TDC 50 comprises a VCO 210 having 25 serially-connected inverters.

As further shown in FIG. 6, each inverter provides an output to the EFLL 400 and CFLL 600. For example, the first inverter 212 provides an output to the EFLL 400 over a link 228. The first inverter 212 also provides this same output to the CFLL 600 over a link 229. Similarly, the second inverter 214 provides an output to the EFLL 400 over a link 230. The second inverter 214 also provides this same output to the CFLL 600 over a link 231. Likewise, the third inverter 216 provides an output to the EFLL 400 over a link 232. The third inverter 216 also provides this same output to the CFLL 600 over a link 233. Similarly, the fourth inverter 218 provides an output to the EFLL 400 over a link 234. The fourth inverter 218 also provides this same output to the CFLL 600 over a link 235. Likewise, the fifth inverter 220 provides an output to the EFLL 400 over a link 236. The fifth inverter 220 also provides this same output to the CFLL 600 over a link 237. Finally, the sixth inverter 222 provides an output to the EFLL 400 over a link 238. The sixth inverter 218 also provides this same output to the CFLL 600 over a link 238. As illustrated in FIG. 6 by dots appearing between the link 230 and the link 232 and by dots appearing between the link 234 and the link 236 at the link connections to the EFLL 400, the number of connections between the VCO 210 and the EFLL 400 varies with the number of inverters comprising the embodiment of the VCO 210. Similarly, as illustrated in FIG. 6 by dots appearing between the link 231 and the link 233 and by dots appearing between the link 235 and the link 237 at the link connections to the CFLL 600, the number of connections between the voltage controlled oscillator 210 and the CFLL 600 correspondingly varies with the number of inverters comprising the VCO 210. In an embodiment, the link 350 shown in FIG. 2 comprises the links 228-239 shown in FIG. 6.

The VCO 210 operates by exploiting the gate delay of each inverter. Each of the inverters 212, 214, 216, 218, 220, and 222 further comprises a gate having a charge delay. The gate charge delay is a period of time which, beginning with the time an output from the upstream inverter arrives at the downstream inverter input, the gate requires to charge before it applies an output to the downstream inverter. Consequently, each serially-connected inverter realizes a delay before it provides its output pulse to the downstream inverter, and to the respectively connected EFLL 400 and CFLL 600. Advantageously, this delay period can be made substantially uniform by carefully controlling the construction of the inverter. Advantageously, the substantially uniform delay period of the inverters can be uniformly changed by altering the speed control input voltage 224 and the duty cycle control input voltage 226 applied as common inputs to each of the inverters 212, 214, 216, 218, 220, and 222. Thus, starting from the time the inverter 212 receives the clock input over the link 240, the serially-connected inverters 212, 214, 216, 218, 220, 222 successively issue an output staggered in time by a fixed delay period, the delay period being determined by the speed control input 224 and duty cycle control 226 applied to the voltage controlled oscillator inverters.

For example, starting at $t_0$, the first inverter 212 changes its output at $(t_0+d_{212})$, and changes the output applied to link 228. Upon receipt of that output via link 228, the second inverter 214 changes its output after its corresponding charging delay, or at $(t_0+d_{212}+d_{213})$. This process continues for each of the serially-connected inverters of the voltage controlled oscillator 210, and in the illustrated example, when the sixth inverter changes its output at ($t_0+d_{212}+d_{214}+d_{216}+d_{218}+d_{220}+d_{222}$). A new cycle of sequential output changes then begins, with the first inverter receiving a subsequent pulse from the calibration clock 248 over link 240, and each inverter again marks time by sequentially changing its output by the inverter's respective characteristic capacitive charging delay time.

Advantageously, the VCO 210 is externally-controllable using the speed control input voltage and duty control voltage in a linear region that corresponds to a time interval (bin size) useful in the TDC 50. The time interval between successive inverter outputs is controlled by the speed control input voltage 224 and the duty cycle control input voltage 226 applied to the inverters 212, 214, 216, 218, 220, and 222. Thus, in an embodiment where the duty cycle voltage ranges from approximately 0.9 volts to around 0.6 volts and the speed voltage correspondingly ranges from approximately 0.0 volts to about 1.0 volts, a substantially linear inverter delay interval response correspondingly ranges between approximately 78 picoseconds to 515 picoseconds. In an embodiment, a speed voltage of about 0.0 volts and a duty cycle voltage of about 0.9 volts yield a delay interval of about 78 picoseconds between an output of a current starved inverter delay cell in each stage of the voltage controlled oscillator. In an embodiment, a speed voltage of about 1.0 volts and a duty cycle voltage of about 0.6 volts yield a delay interval of about 515 picoseconds between successive outputs of current starved inverter delay cells in each stage of the voltage controlled oscillator.

Advantageously, external control of the voltage controlled oscillator 210 allows for stabilized operation comprising continuous monitoring and adjustment bin increment delay interval. As shown in FIG. 6, the external clock 248 provides course timing interval updates to the CFLL 600. The CFLL 600 also receives the succession of relatively fine time intervals between successive bin increments from each stage of the BIG 200. Using logic resident in the CFLL 600, the CFLL 600 compares a ratio of the fine time intervals (received from the voltage controlled oscillator 210) to course time intervals (received from the external clock 248), such as by comparing to a target ratio or by using a proportionality constant. On the basis of a differential between the actual to target, the CELL 600 adjusts the interval in a succeeding cycle of bin increments through logic resident in at least one of the CFLL 600 and the DPM 800. By continuously monitoring the BIG 200 with logic resident on other modules, the voltage controlled oscillator is thereby stabilized such that the time interval between time increments is dialed in prior to the receipt of an initial start event by the AFE 100. Predictable, reliable time measurement is therefore achieved through a stabilized mode of operation comprising continuous monitoring and interval calibration.

As also shown in FIG. 6, the output of the third stage inverter 216 connects to the data readout clock module 300 over a link 242. The third stage inverter 216 output also connects to the synchronization counter module 500 over a link 243. Thus, since the each VCO 210 cycle comprises a sequential cascade of output pulses, the link 242 provides a single pulse to the readout clock of the cascade to the readout clock module per cycle. Similarly, the link 243 also provides this same single pulse to the synchronization counter module 500 once per cycle. Thus, each of the readout clock module 300 and synchronization counter module are updated on an interval equal to the number of VCO stages times the inverter delay period. Advantageously, these cyclic updates to other modules allow the VCO counts to be compared to an external clock count, and adjusted with logic resident in the DPM 800. In an embodiment, the BIG 200 comprises 25 stages having a delay interval of between substantially 100 picoseconds and 500 picoseconds, the readout clock 300 receives a count increment between about 25×100 picoseconds and 25×500 picoseconds.

Figure 7:
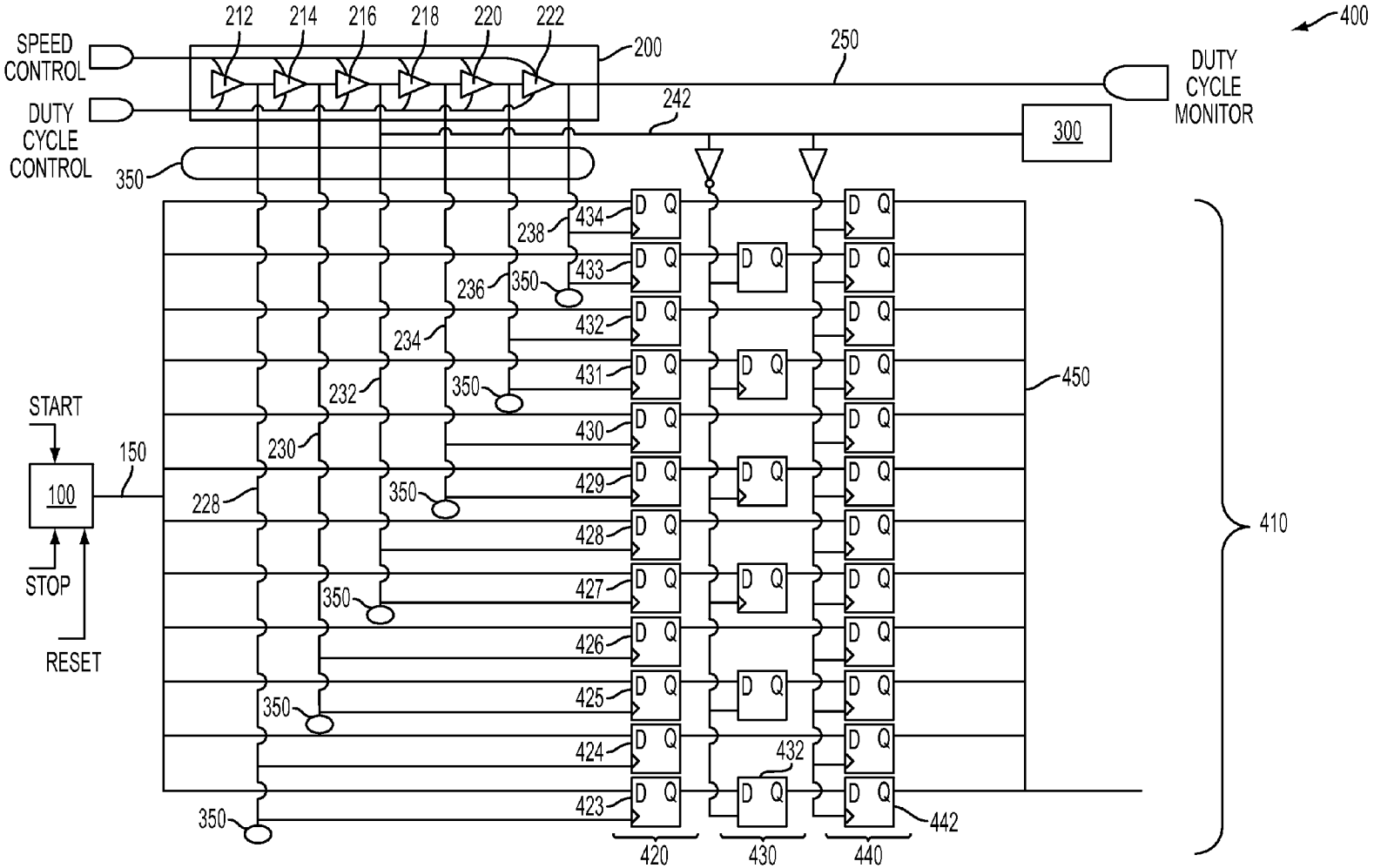
FIG. 7 is a block diagram of an event frame latches and logic module of the timing electronics of FIG. 2.

FIG. 7 shows an exemplary embodiment of the EFLL 400.

The EFLL 400 comprises a plurality of group of storage cells 410, a single group 410 being illustrated in the figure. The group 410 further comprises a first column 420, a second column 430, and a third column 440. Each column 420, 430, and 440 has a plurality of storage cell comprising flip-flops, flip-flop 422 representatively illustrating a cell of the first column 420, flip-flop 432 representatively illustrating a cell of the second column 430, and flip-flop 442 representatively illustrating a cell of the third column 440. The arrangement shown in FIG. 7 is for illustration purposes only; the physical arrangement of the storage cells in embodiments of the TDC 400 as implemented as an ASIC in silicon may be different. The grouping of cells into columns is for purposes grouping cells having similar functions, and does not represent a structural limitation of embodiments of the EFLL 400. In an embodiment, the ASIC occupies a die of approximately 5 mm×5 mm die size using a 180 nm CMOS process manufacturing process. In embodiments, the ASIC features are arrayed within the die so as to provide a radiation-hardened TDC. Advantageously, such embodiments mitigate against single event upsets and single event latchup.

The flip-flops of the columns 420, 430, and 440 each comprise a clock input (shown with a '>' sign in the figure), a data input D, and an output Q. Each flip-flop is configured to store either a 0-bit or a 1-bit for a given clock cycle, the cell contents being updated at the beginning of a succeeding clock cycle. In an embodiment, the columns 420, 430, and 440 comprise edge-triggered flip-flops that store a 1-bit where a high value is present on the D-input and at the moment a clock pulse is applied to the clock input. Oppositely, where the edge-triggered flip-flops store a 0-bit where a low value is present of the D-input at the moment a clock pulse is applied to the clock input.

Each of the D inputs of the flip-flops comprising the first column 420 connects to the AFE 100 over the link 150. Thus, when AFE 100 receives the above-described start event, the AFE applies a high to the D input of the flip-flops of the first column 420.

Each of the clock inputs of the flip-flops comprising the first column 420 connect to a corresponding output of a stage of the VCO 210. For example, flip flops 423 and 424 connect to the output of the first stage inverter 212 over the link 228. Similarly, flip flops 425 and 426 connect to the output of the second stage inverter 214 over the link 230. Likewise, flip flops 427 and 428 connect to the output of the third stage inverter 216 over the link 228. Similarly, flip flops 429 and 430 connect to the output of the fourth stage inverter 218 over the link 234. Likewise, flip flops 431 and 432 connect to the output of the fifth stage inverter 220 over the link 236. Finally, flip flops 433 and 434 connect to the output of the sixth stage inverter 222 over the link 238. The output of the flip flops 423-434 connects to the link 450, thereby providing a data conduit to the data processing and manipulation algorithms operative within the DPM 700. In another embodiment of the TDC 50 has a VCO 210 with 25 stages and a corresponding number of flip-flops connected in the manner as those illustrated in FIG. 7.

Operatively, the AFE 100 provides one of a relatively constant high or low to the data input D of the flip-flops 423-434. While the AFE 100 applies its high or low signal to the flip-flop D inputs, each VCO stage inverter 212, 214, 216, 218, 220, and 222 sequentially applies a clock pulse to the clock input of the a respective pair of flip-flops. Consequentially, based on the AFE input at the time a clock pulse is applied to a given flip-flop, a 1-bit or a 0-bit is stored in the cell. The second column of flip-flops 430 and third column of flip-flops 440 cooperate with the pulses delivered over the readout clock link 242 to manage the opposite voltage pulses issued by the VCO stages such that, for a cycle of the VCO 210, a corresponding string of bits is provided to the DPM 700 over the link 450 representing the state of the AFE 100 signal during the interval the VCO cycled.

For example, in an exemplary embodiment of the TDC 50 having a VCO with inverters having a 500 picosecond delay and the AFE 100 running in a stabilized condition, the EFLL 400 sequentially stores a 0-bit in a flip-flop every 500 picoseconds. In this mode, every VCO cycle a data string comprising 25 0-bits gets passed to the DPM every 25×500 picoseconds. In an embodiment, the delay (or bin size) is adjustable between 100 picosecond and 500 picoseconds.

Were the AFE 100 to apply receive a start event 4 nanoseconds into an initial VCO cycle $T_1$, the EFLL 400 would memorialize the start event by creating a 25-bit data string transitioning from a 0-bit to a 1-bit at the ninth bit position. The string would thereby memorialize that 8 VCO sequences occurred in the VCO cycle before the AFE 100 recognized the start event. The resultant 25-bit data string (or frame) would be:

$T_1$: 0000000011111111111111111

At the end of the first VCO cycle the EFLL 400 passes the data string $T_1$ to the DPM 700, which associate the data string $T_1$ with its predecessor and successor data strings.

Assuming the no stop event were registered for a second VCO cycle following the stop event, a succeeding 25-bit data string (or frame) would be:

$T_2$: 1111111111111111111111111

At the end of the second VCO cycle the EFLL 400 passes the data string $T_2$ to the DPM 700, which associates the data string $T_2$ with string $T_1$ and its predecessor strings.

Were the AFE 100 to apply receive a stop event at 6 nanoseconds into VCO cycle $T_3$, the EFLL 400 would memorialize the stop event by creating a 25-bit data string $T_3$ transitioning from a 1-bit to a 0-bit at it thirteenth bit position. The string would thereby memorialize that 12 VCO sequences occurred in the VCO cycle before the AFE 100 recognized the stop event. The resultant 25-bit data string (or frame) would be:

$T_3$: 1111111111110000000000000

At the end of the third VCO cycle the EFLL 400 passes the data string $T_3$ to the DPM 700, which associates the data string $T_3$ with predecessor strings $T_2$, $T_1$ and their predecessor strings. The DPM 700 would aggregate the 1-bits in strings $T_1$, $T_2$, and $T_3$, multiply them by the VCO time interval. Were TDC 50 measuring time in the above-discussed TOF-MS, the DPM 700 (or other associated processor) would arrive at a particle flight time of 500 picoseconds times 55, or 22.5 nanoseconds, for insertion into a histogram of flight time usable in identifying the unknown substance introduced in the TOF-MS.

Figure 8:
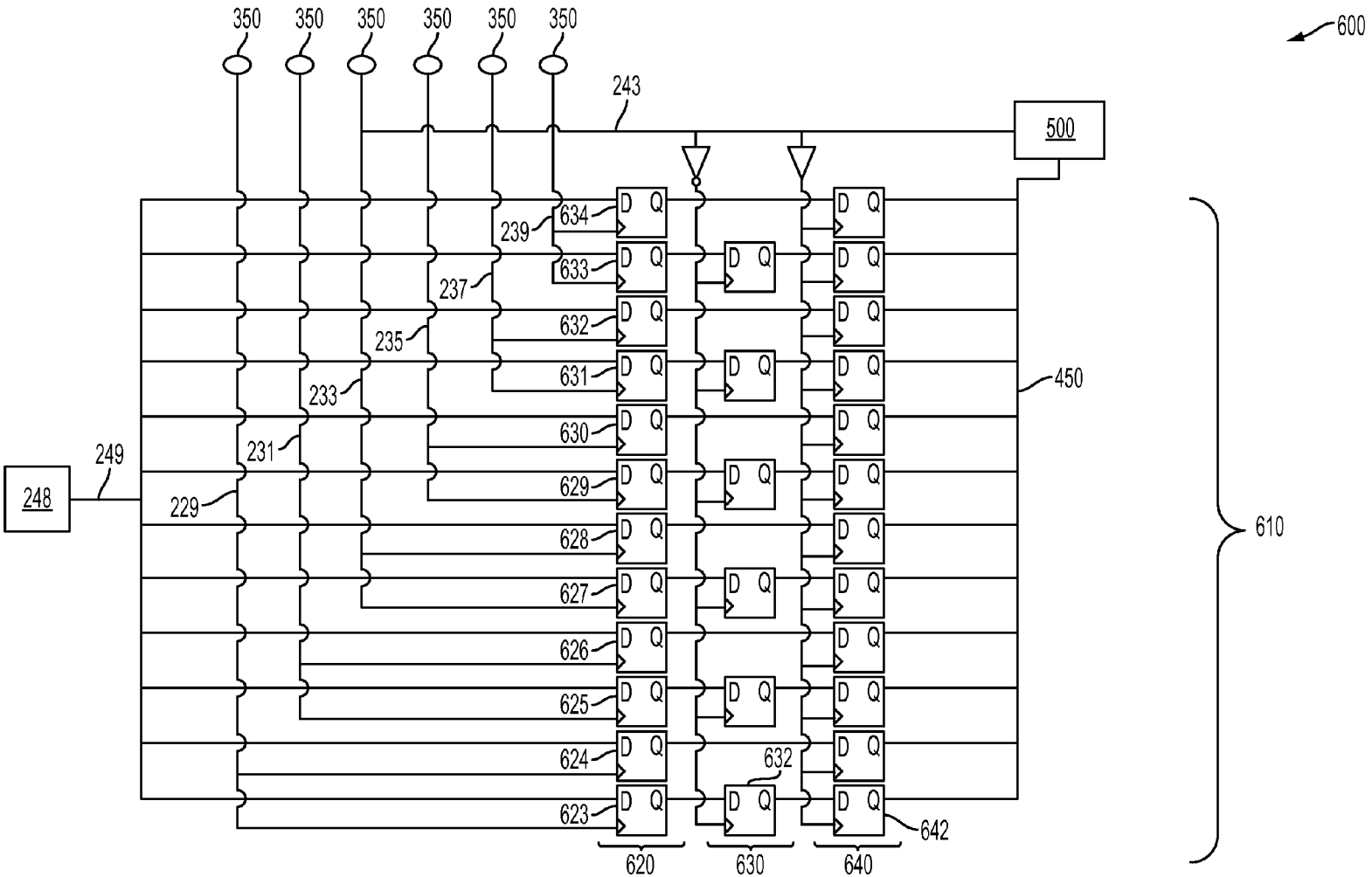
FIG. 8 is a block diagram of a calibration frame latches and logic module of the timing electronics of FIG. 2.

FIG. 8 shows an exemplary embodiment of the CFLL 600.

The CFLL 600 comprises a plurality of group of storage cells 610, a single group 610 being illustrated in the figure. The group 610 further comprises a first cell column 620, a second cell column 630, and a third cell column 640. Each cell column 620, 630, and 640 has a plurality of storage cells comprising flip-flops, flip-flop 623 representatively illustrating a cell of the first column 620, flip-flop 632 representatively illustrating a cell of the second cell column 630, and flip-flop 642 representatively illustrating a cell of the third cell column 640. The arrangement shown in FIG. 8 is for illustration purposes only; the physical arrangement of the storage cells in embodiments of the TDC 400 as implemented as an ASIC in silicon may be different. The grouping of cells into columns is for purposes grouping cells having similar functions, and does not represent a structural limitation of embodiments of the CFLL 600.

The flip-flops of the columns 620, 630, and 640 each comprise a clock input (shown with a '>' sign in the figure), a data input D, and an output Q. Each flip-flop is configured to store either a 0-bit or a 1-bit for a given clock cycle, the cell contents being updated at the beginning of a succeeding clock cycle. In an embodiment, the columns 620, 630, and 640 comprise edge-triggered flip-flops that store a 1-bit where a high value is present on the D-input and at the moment a clock pulse is applied to the clock input. Oppositely, where the edge-triggered flip-flops store a 0-bit where a low value is present of the D-input at the moment a clock pulse is applied to the clock input.

Each of the D inputs of the flip-flops comprising the first column 620 connects to an external calibration clock 248 over a link 249. Thus, the external calibration clock 248 applies a high to the D input of the flip-flops of the first column 420 during a calibration event. Advantageously, a calibration cycle frequency (or interval) can therefore be applied as is necessary in a given application of the TDC 50.

Each of the clock inputs of the flip-flops comprising the first column 620 connect to a corresponding output of a stage of the VCO 210. For example, flip flops 623 and 624 connect to the output of the first stage inverter 212 over the link 229. Similarly, flip flops 625 and 626 connect to the output of the second stage inverter 214 over the link 231. Likewise, flip flops 627 and 628 connect to the output of the third stage inverter 216 over the link 229. Similarly, flip flops 629 and 630 connect to the output of the fourth stage inverter 218 over the link 235. Likewise, flip flops 631 and 632 connect to the output of the fifth stage inverter 220 over the link 237. Finally, flip flops 633 and 634 connect to the output of the sixth stage inverter 222 over the link 239. The output of the flip flops 623-634 connects to the link 450, thereby providing a calibration data conduit to the data processing and manipulation algorithms resident within the DPM 700. In another embodiment of the TDC 50 has a VCO 210 with 25 stages and a corresponding number of flip-flops connected in the manner as those illustrated in FIG. 8.

Operatively, the external calibration clock 249 functions analogously as the AFE 100 functions with the EFLL 400. The external calibration clock 249 selectively applies a calibration high signal on the D input of the flip flops 623-634 for a calibration clock cycle. While the external calibration clock 248 applies its high or low signal to the flip-flop D inputs, each VCO stage inverter 212, 214, 216, 218, 220, and 222 sequentially applies a clock pulse to the clock input of the a respective pair of flip-flops as described above. Consequentially, based on an input of the external calibration clock 248 at the moment a clock pulse is applied to a given flip-flop, a 1-bit or a 0-bit is stored in the cell. The second column of flip-flops 830 and third column of flip-flops 840 cooperate with the pulses delivered over a synchronization clock link 243 to manage the opposite voltage pulses issued by the VCO stages such that, for a cycle of the VCO 210, a corresponding string of bits is provided to the DPM 700 over the link 450 representing a correspondence of the VCO time delay (interval) with respect to an external calibration clock.

For example, by storing a sequence of 1-bits in storage cells during a calibration time interval, a ratio of VCO delay intervals to the calibration time interval may be determined. This ratio can then be compared to a target ratio, and the VCO delay interval adjusted by altering the duty cycle control and the speed control voltages applied to the VCO. In an embodiment, successive calibration cycles can be applied to 'walk' an identified erroneous VCO delay interval to its target with well-known process control techniques, for example through the application of Westinghouse run chart adjustment rules.

Figure 9:
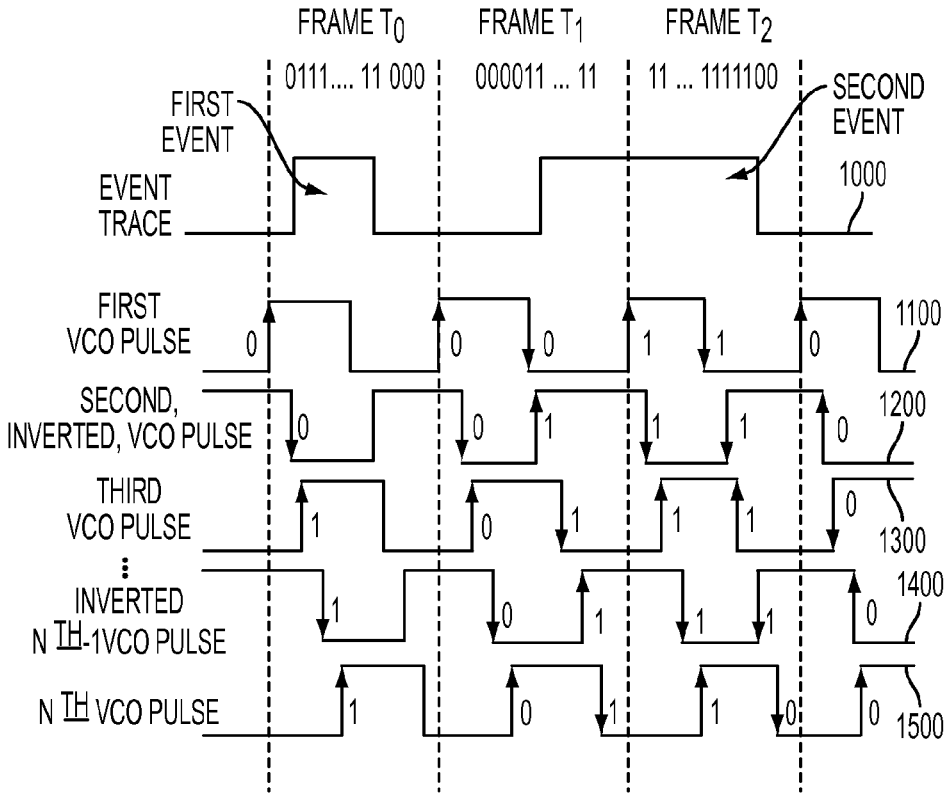
FIG. 9 illustrates graphically the zero dead time of an embodiment of the time-to-digital converter.

FIG. 9 illustrates graphically the zero-dead time operation of the TDC 50.

An upper event trace 1000 has a first event and a second event. The frames written (stored) to the EFLL 400 during three successive VCO cycles appears across the top of the event trace as a first, second, and third sequence of 0-bits and 1-bits. A sequence of VCO pulses appears under the event trace, a first VCO phase (stage output) illustrated as a trace 1100, a second VCO phase (stage output) illustrated as a trace 1200, a third VCO phase (stage output) illustrated as a trace 1300, a second to last VCO phase (stage output) illustrated as a trace 1400, and a final VCO phase (stage output) illustrated as a trace 1500.

As shown the figure, zero dead time operation is achieved by using an inverting and a non-inverting phase of the inverter output of each stage to periodically capture the input signal into a frame. This feature allows the TDC 50 to generate a frame in time delay that contains the time information for a leading edge, a trailing edge, and an event pulse width which is desirable in applications requiring precession time measurement.

In the embodiment of FIG. 9, the TDC is a zero-dead time TDC 50 implemented using an ASIC. An AFE 100 of the TDC 50 is formed using 25 current starved inverters. Each inverter outputs a phase that exhibits an adjustable 100-500 picosecond time delay or time bin size that is set by the speed and duty cycle control voltage. The AFE 100 processes start and stop events, and generates digital pulses corresponding to each event. An EFLL 400 captures the events in separate data frames formed by logic that is clocked by a VCO 210 within a bin increment generator 100 of the TDC 50. The VCO 210 propagates a rising edge followed by a falling edge (or vice versa), the frame is formed by twice the number of inverters comprising the VCO 210. For the event data, the raw bits are sent off the ASIC while the calibration data is further processed on the ASIC by the detecting the leading edge and trailing edge, and encoding the data to compress it.

In the embodiment, each frame contains fine time information relative to the phases of the VCO 210, while the readout clock provides coarse timing. In this way, the device is able to handle multiple stop events at a very high event rate. In an embodiment, a device external to the TDC 50 ASIC processes the timing frame data.

Advantageously, a zero dead time TDC allows for construction of a smaller mass spectrometer because it can distinguish individual ion detector impacts separated by smaller time intervals. Being able to distinguish ion impacts separated by smaller time intervals in turn allows for reducing the length of the flight path taken by the ions. Reducing the flight path taken by the ions allows for further miniaturization of the mass spectrometer. Further miniaturization of the mass spectrometer makes the device suited for applications where size and weight are limited, such as in space exploration and in-situ planetary science, where launch weight factors heavily into instrument package selection.

Thus, while there have been shown, described and pointed out, fundamental novel features of the invention as applied to the exemplary embodiments thereof, it will be understood that various omissions and substitutions and changes in the form and details of devices and methods illustrated, and in their operation, may be made by those skilled in the art without departing from the spirit of the invention. Moreover, it is expressly intended that all combinations of those elements and/or method steps, which perform substantially the same function in substantially the same way to achieve the same results, are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A time-to-digital converter, comprising:

an event frame latches and logic module having a plurality of memory cells;

an analog front-end module connected to the event frame module; and a bin increment generator module connected to the event frame latches and logic module, wherein the bin increment generator module is configured to issue a sequence of bin increments to the event frame latches and logic module and wherein a successive bin increment follows a predecessor bin increment by a time interval, wherein the analog front-end module is configured to issue an event start indication to the event frame latches and logic module, wherein the analog front-end module is configured to issue at least one event stop indication to the event frame latches and logic module, wherein the event frame latches and logic module is configured to update at least one memory cell when the bin increment generator module issues a bin increment, and wherein the memory cell update comprises a first bit-type following the issue of the start event indication, and wherein the memory cell update comprises a second bit-type following the issue of the stop event indication.

2. The time-to-digital converter of claim 1, further comprising:

a calibration frame latches and logic module having a plurality of memory cells, the calibration frame latches and logic module being connected to the bin increment generator; and a calibration clock connected to the calibration frame latches and logic module, wherein calibration clock is configured to issue a calibration start indication to the calibration frame latches and logic module, wherein the calibration clock is configured to issue a calibration stop indication to the calibration frame latches and logic module, and wherein the calibration frame latches and logic module is configured to update at least one memory cell when the analog front-end module issues a bin increment.

3. The time-to-digital converter of claim 1, wherein the bin increment generator comprises an voltage controlled oscillator having a twenty five stages, wherein an output of the twenty fifth stage comprises an input of the first stage.

4. The time-to-digital converter of claim 3, wherein stage 13 increments a cycle counter connected to the thirteenth stage.

5. The time-to-digital converter of claim 1, wherein a first time increment issued by the bin increment generator and a successive second time increment issued by the bin increment generator are separated by a time interval greater than 100 picoseconds and less than 500 picoseconds.

6. The time-to-digital converter of claim 5, wherein the time interval is linearly variable between a 100 picoseconds and 500 picoseconds using a duty cycle control voltage and speed control voltage applied to the bin increment generator.

7. The time-to-digital converter of claim 5, wherein the time increment is demarcated by a leading edge pulse and a trailing edge pulse, the trailing edge pulse being inverter with respect to the leading edge pulse.

8. The tune-to-digital converter of claim 1, the wherein the analog front-end module is configured to issue an event start indication following an analog input to the analog front-end module.

9. The time-to-digital converter of claim 1, the wherein the analog front-end module is configured to issue an event start indication following a digital input to the analog front-end module.

10. A method of time-to-digital conversion, the method comprising:

at a time-to-digital converter comprising an event frame latches and logic module with a plurality of memory elements, the event frame and logic module being connected to a bin increment generator module and an analog front-end module;

issuing an event start indication to the event frame latches and logic module using the analog front end module;

issuing a first bin increment to the event frame latches and logic module using the bin increment generator module;

storing, upon the issuing of the first bin increment, a first bit in a first memory cell of the event frame latches and logic module;

issuing an event stop indication to the event frame latches and logic module using the analog front end module;

issuing a second bin increment to the event frame latches and logic module using the bin increment generator module; and storing, upon the issuing of the second bin increment, a second bit in a second memory cell of the event frame latches and logic module;

wherein the first bit is of a first bit-type and the second bit is of a second bit-type, and wherein the first bit-type is of a different than the second bit-type, thereby memorializing the receipt of the intervening issue of the event stop indication by the analog front-end module.

11. The method of claim 10, wherein the time-to-digital converter further comprises a calibration frame latches and logic module and a calibration clock, and wherein the method further comprises:

receiving, at the calibration frame latches and logic module, a plurality of increments issued by the bin increment generator;

receiving, at the calibration frame and latches and logic module, a calibration clock increment, relating a plurality of the received increments issued by the bin increment generator to at least one calibration clock increment; and adjusting a time interval between successive bin increments based on the relationship of the calibration clock increment to the plurality of bin increment generator increments.

12. The method of claim 11, wherein the relating a plurality of count increments to at least one calibration clock increment further comprises:

determining a ratio of the bin increment interval to the calibration clock interval, and wherein the adjusting the time interval between successive bin increments further comprises comparing the determined ration to a target ratio.

13. A time-of-flight mass spectrometer system, comprising:

a flight path of known length having a start point and an end point;

an accelerator coupled to the flight path at the start point of the flight path;

a detector coupled to the flight path at the end point of the flight path;

a time-to-digital converter module connected to the accelerator and the detector, the time-to-digital converter comprising an event frame latches and logic module with a plurality of memory cells, an analog front-end module, and a bin increment generator module;

a processor connected to the time-to-digital converter module; and a memory connected to the processor and having recorded thereon instructions, that when read by the processor, cause the time-to digital converter module to:

issue an event start indication to the event frame latches and logic module using the analog front end module;

issue a first bin increment to the event frame latches and logic module using the bin increment generator module;

store, upon the issue of the first bin increment, a first bit in a first memory cell of the event frame latches and logic module, wherein the event frame latches and logic module memorializes the issue of the start event issue by storing the first bit as a first bit-type;

issue an event stop indication to the event frame latches and logic module using the analog front end module;

issue a second bin increment to the event frame latches and logic module using the bin increment generator module; and store, upon the issuing of the second bin increment, a second bit in a second memory cell of the event frame latches and logic module, wherein the event frame latches and logic module memorializes the issue of the stop event issue by storing the second bit as a second bit-type, the second bit-type being different than the first bit-type.

* * * * *